United States Patent [19]

Fabrygel

[11] 4,398,598

[45] Aug. 16, 1983

[54] BREAK-OUT TOOL FOR ANNULAR TYPE BLOW-OUT PREVENTERS

[76] Inventor: Joe H. Fabrygel, Rte. 1, Box 424, West Columbia, Tex. 77486

[21] Appl. No.: 264,641

[22] Filed: May 18, 1981

[51] Int. Cl.[3] ..... E21B 19/16; E21B 33/06

[52] U.S. Cl. ..... 166/85; 166/379; 81/57.39; 29/240

[58] Field of Search ..... 166/85, 77.5, 379, 79; 81/57.39, 57.34, 57.35, 57.36; 29/240, 426.5; 173/164

[56] References Cited

U.S. PATENT DOCUMENTS 2,615,681 10/1952 True ..... 166/79
4,023,449 5/1977 Boyadjieff ..... 81/57.34 X
4,309,923 1/1982 Wilmeth ..... 81/57.39 X

*Primary Examiner*—Ernest R. Purser
*Assistant Examiner*—Thuy M. Bui
*Attorney, Agent, or Firm*—Pravel, Gambrell, Hewitt, Kirk & Kimball

[57] ABSTRACT

Apparatus for removing the frozen head of an annular type blow-out preventer, wherein an annular frame is mounted over the threadedly attached head leaving a central, top portion of the blow-out preventer head exposed to receive a torque arm adapted to be secured to the preventer head, torque being applied to the torque arm from hydraulic power assemblies mounted on the frame for breaking the threaded connection between said preventer head and body.

8 Claims, 3 Drawing Figures

BREAK-OUT TOOL FOR ANNULAR TYPE BLOW-OUT PREVENTERS

FIELD OF THE INVENTION

This invention relates to the field of torque applying apparatus for removing the threaded head of annular type blow-out preventers.

DESCRIPTION OF THE PRIOR ART

Annular blow-out preventers are well known in the arts. An example of such annular type preventer is made by Hydril of Houston, Texas, designated as Type "GL" and Type "GK". In the servicing of annular blow-out preventers, the preventer head must be removed for access to the interior seal. Often the metallic preventer head adheres to the preventer body due to corrosion and metal-metal bonds occurring in the threaded area. In the past, the head would be broken loose using either the brute force of the maintenance personnel or by hitting the head with heavy objects. Both these situations pose serious safety hazards to personnel and in most circumstances are of dubious utility.

As of the present, the inventor is unaware of a tool device which is capable of mounting onto the body of such an annular blow-out preventer and removing or at least breaking loose the threaded connection between the head and the body. U.S. Pat. No. 3,446,284 of Dyer generally discloses the use of non-aligned opposing hydraulic cylinders in combination with a ratchet gear to exert torque on a drill pipe in unsecuring threaded connections.

The Dyer '284 patent teaches the use of non-aligned opposing hydraulic rams to unscrew threaded sections of pipe, but could not be used to remove the preventer head. A ratchet dog and gear are used in the application of the torque to rotate the drive member in a direction to unscrew the threaded pipe and a slip is utilized to engage flat portions of the pipe which cannot be readily adapted to the blow-out preventers which normally have no such usual flat areas on the preventer head.

The U.S. Pat. Nos. 3,662,823 and 3,741,295 disclose method and apparatus to retrieve and replace blow-out preventer packers in a blow-out preventer body in a sub-sea well head location. Although describing the preventer and the preventer head, no means is disclosed to aid in the removal of sticking preventer heads.

U.S. Pat. No. 3,561,723 describes generally a stripping and blow-out preventer device for use in well drilling operations, but no device for the removal of the preventer head is disclosed.

U.S. Pat. Nos. 3,821,838; 3,737,974 and 4,003,430 relate generally to apparatus and methods for the replacement of seals in a ram type blow-out preventer. Since the ram type blow-out preventer is distinctively different from an annular type blow-out preventer, the patents do not disclose any device or means for removing a preventer head such as used in an annular type blow-out preventer.

SUMMARY OF THE INVENTION

The present invention relates to a new and improved apparatus for removing the threaded head of an annular type blow-out preventer. The present invention makes it possible to exert removal torque on the head for its removal to replace the preventer packer seals in far less time than required previously to break the frozen head loose. The present break-out tool actually mounts on the preventer body with a torque arm secured to the head. The apparatus comprises a mounting frame adapted for attachment to the blow-out preventer body, the frame having a central opening which exposes the top portion of the threadedly atttached blow-out preventer head. A torque arm is attached to the preventer head; and a torque applying means mounted on the frame engages the torque arm for breaking the frozen threaded connection between said preventer head and body.

DESCRIPTION OF THE PREFERRED EMBODIMENT

Figure 1:
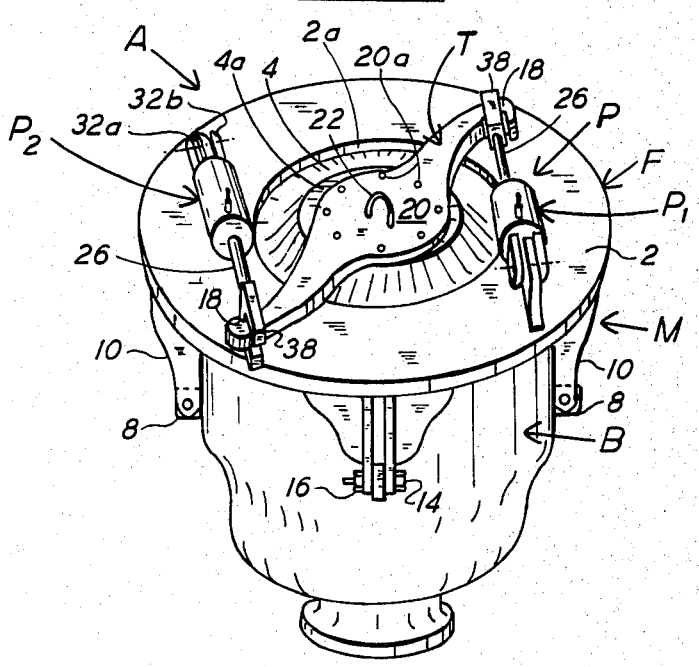
FIG. 1 is a perspective view of one embodiment of the breakout tool of the present invention mounted upon an annular type blow-out preventer.
Figure 2:
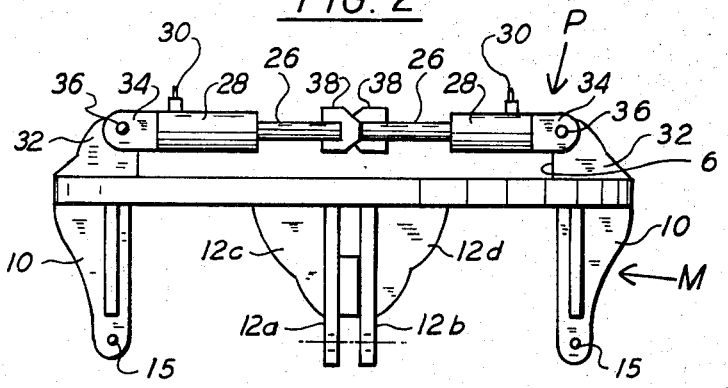
FIG. 2 is a side view of the present invention.

Referring now to FIG. 1, the apparatus A of the present invention for removing the head 4 of an annular type blow-out preventer generally comprises a mounting frame F having a central opening 2*a* which is adapted to leave a central, top portion of the threadedly attached blow-out preventer head 4 exposed; a mounting means M for mounting the frame F to the annular type blow-out preventer body B; a torque arm T securable to the preventer head; and a torque applying means P for producing torque that is transmitted by the torque arm for breaking the frozen threaded connection between the preventer head and body.

As illustrated in FIG. 1, the blow-out preventer is of an annular type and includes a generally cylindrical body B having a threaded portion (not shown) which receives a complementary threaded portion (not shown) of a head 4. In order to replace any of the annular sealing mechanism or otherwise repair or refurbish the blow-out preventer, it is necessary to first remove the head to give access to the internal area of the preventer. It is this threaded connection between the blow-out preventer head and the body B which is often resistant to any removal using any standard tools.

In the preferred embodiment of the break-out tool A, the frame F is an annular disc or plate 2 having a central opening 2*a* which is adapted to leave a central, top portion 4*a* of the blow-out preventer (hereinafter referred to as "BOP") head 4 exposed. It is preferred that the size of central opening 2*a* is such as to permit plate 2 to rest upon the shoulders of the blow-out preventer body B. The thickness of disc 2 depends upon the type of material chosen for disc 2. Since torque applying means P when in operation is anchored to disc 2, the thickness must be such as to provide rigidity, while at the same time being desirable that disc 2 be thin enough as to allow the uppermost portion of the BOP head to rise above said disc 2, as will be more fully discussed below.

Mount means M mounts frame F to the annular type blow-out preventer body B. Generally, mount means M comprises four mounting brackets 10 evenly circumferentially spaced about the frame F. Each bracket 10 includes spaced, depending flanges 12*a* and 12*b* which are attached to and extend downwardly from the disc 2 and which are separated so as to lie on either side of BOP body lugs 8, also circumferentially spaced about the body B. When the tool A is mounted on an annular BOP, the mounting flanges 12*a* and 12*b* come into alignment with and are connectable to lugs 8. For safety reasons bolt 14 and nut 16 extend through aligned holes 15 in the lugs 8 and flanges 12*a-b* so as to prevent slippage of the breakout tool frame F from off of the lugs 8. The flanges 12*a* and 12*b* of the bracket 10 are supported by gussets 12*c* and 12*d*.

The torque arm T is adapted to be secured to the top portion 4*a* of the preventer head 4 for movement with said preventer head. Referring to FIG. 1, the torque arm T is of suitable thickness and dimensions so as to transmit the torque produced by torque applying means P to the top portion 4*a* of the BOP head 4 without failing. Preferably, torque arm T is positioned directly on the blow-out preventer head and is attached thereto at the mid section 20 of arm T by bolts or pins extending through bolt holes 20*a* in the torque arm T into the blow-out preventer head. The outer, opposite end portions of torque arm T terminate approximately adjacent to frame F and have concave segments 18 for receiving the torque applying means P. A ring 22 is affixed to the midpoint of arm T to aid the removal of the arm.

The torque applying means P is mounted with frame F and extends into engagement with torque arm T for applying torque to torque arm T, which transmits the torque to the preventer head 4 attached thereto for breaking a frozen threaded connection between the preventer head 4 and body B. Preferably, oppositely positioned power means $P_1$ and $P_2$ (FIG. 1) are mounted on frame F and extend into contact with opposing end portions of torque arm T for the application of opposite forces to the ends of torque arm T, thereby applying a combined torque thereto.

In the embodiment of the novel break-out tool apparatus A, the oppositely positioned power means $P_1$ $P_2$ are hydraulic cylinder assemblies that are pivotally attached to frame F. Each hydraulic cylinder assembly includes a piston rod 26 which extends into engagement with torque arm T. Each hydraulic cylinder 28 has at least one coupling or pressure fitting 30 through which hydraulic pressure can be applied to cause the extension of piston rod 26. As the oppositely positioned and directed piston rods 26 extends out of cylinders 28, the torque arm T is rotated to break the frozen head out of the BOP body.

Bracing studs 32 are mounted on the surface of the disc 2 in approximate diagonal alignment and support and anchor piston cylinders 28. Piston cylinders 28 each have ears 34 at the end adjacent to piston brace 32 which lie on either side of piston brace 32. Cylinders 28 are pivotally connected to brace 32 by pivot pins 36 which allows limited movement generally in an up and down direction. The piston rods 26 terminate in U-shaped sections 38 for engaging the concave portions 18 of the torque arm T. The U-shaped sections 38 will prevent piston rods 26 from disengagement with arm T during the operation of the device.

Figure 3:
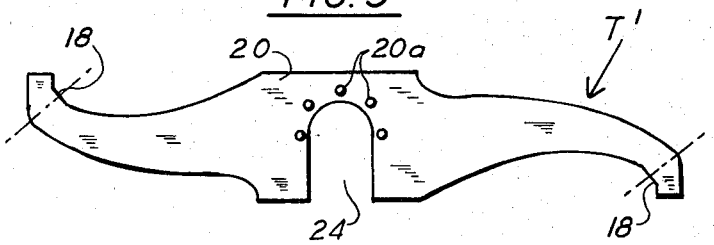
FIG. 3 is a top view of the torque arm with a U-shaped notch.

In FIG. 3, another embodiment of torque arm T′ is shown for those applications in which a marine riser or pipe section remains in place in the BOP. Here the torque arm T′ has a U-shaped opening 24 permitting arm T′ to be placed in proper position around such pipe or riser joint. This configuration yields the added advantage that the break-out tool A can be utilized to remove the BOP head even when a pipe joint is in place. When the apparatus A is used to remove a head 4 having a stuck joint, it is desirable that disc 2 be constructed in two sections, such as in half sections along a diameter, which configuration would similarly permit disc 2 to be mounted on to the BOP body B in spite of the pipe joint being stuck in the BOP.

Generally the break-out tool A is constructed of a high quality metal such as steel. Since the various components of the break-out tool will undergo substantial torque, it is desired that the metal chosen would have suitable stress resistant characteristics. As mentioned above, the strength of the metal chosen would influence the thickness chosen for the components, especially torque arm T and disc 2.

In operation of the present invention, frame F with mounting means M is placed over an annular type blow-out preventer. Frame F is positioned such that each of the brackets 10 are aligned with BOP body lugs 8. For safety, a bolt or pin 14 is placed through holes 15 in bracket flanges 12*a-b* and lugs 8. Then torque arm T is positioned over top portion 4*a* of the BOP head 4 and is attached thereto by bolts extending through holes 20*a* and extending into the BOP head 4.

Torque power means $P_1$ and $P_2$, with torque arm T having been properly affixed to the BOP head, are then positioned with U-shaped rod end sections 38 in engagement with arm T. Once properly positioned, torque applying power means $P_1$ and $P_2$ are activated to produce a torque transmitted by arm T to break the threaded connection between the BOP body B and head A.

If torque applying means P reached their maximum extension without leaving the BOP head in a condition whereby the maintenance personnel can easily remove the head, then torque arm T would be removed and repositioned on head 4 for repeating the operation. This cycle would be continued until either the BOP head was totally removed from the BOP body or else leaving the BOP head in a condition where the maintenance personnel could continue its removal without the need of the break-out tool.

The foregoing disclosure and description mentioned are illustrative and explanatory thereof, and various changes in the size, shape and material as well as in the details of the illustrated construction may be made without departing from the spirit of the invention and all such changes are contemplated as falling within the scope of the appendant claims. Although this invention has been described with respect to a particular blow-out preventer application, it is within the scope of this invention to apply the invention to other similar situations.

I claim:

1. An apparatus for removing the head of an annular type blow-out preventer comprising;

(a) a frame adapted to be mounted over the head of an annular type blow-out preventer, such preventer head being threadedly attached to the body of the annular type blow-out preventer, said frame having a central opening which is adapted to leave a central, top portion of said blow-out preventer head exposed;

(b) mount means for mounting said frame on to said annular type blow-out preventer body, said mount means including a plurality of depending mounting flanges which extend into connection with lugs on said preventer body;

(c) a torque arm adapted to be secured to the preventer head for movement with said preventer head; and (d) torque applying means mounted with said frame and extending into engagement with said torque arm for applying torque to said torque arm, which transmits said torque to said preventer head attached thereto for breaking the threaded connection between said preventer head and body.

2. The structure set forth in claim 1, including:

said frame being generally annular in configuration.

3. The structure set forth in claim 1, wherein said torque applying means includes:

oppositely positioned power means mounted on said frame and extending into contact with said torque arm for applying opposite forces to the ends of said torque arm for applying a torque thereto.

4. The structure set forth in claim 3, wherein each of said power means includes:

a hydraulic cylinder assembly attached to said frame and including a piston rod extending into engagement with said torque arm.

5. The structure set forth in claim 4, wherein:

pivotal connection means pivotally connecting said hydraulic cylinder assemblies to said frame.

6. The structure set forth in claim 4 or 5, including:

said piston rods terminating in outer end portions having U-shaped sections for engaging said torque arm.

7. The structure set forth in claim 1 or 4, wherein:

said torque arm having outer end portions terminating approximately adjacent to said frame and having concave segments for receiving said piston rods.

8. The structure set forth in claim 1, wherein:

said torque arm having a U-shaped notch for securing to the preventer head while a pipe section is emplaced in the preventer head.

* * * * *